United States Patent [19]

Takahashi

[11] 3,932,034

[45] Jan. 13, 1976

[54] DEVELOPER CONCENTRATION DETECTING AND REPLENISHMENT DEVICE

[75] Inventor: Toru Takahashi, Tokyo, Japan

[73] Assignee: Canon Kabushiki Kaisha, Tokyo, Japan

[22] Filed: June 11, 1974

[21] Appl. No.: 478,451

[30] Foreign Application Priority Data

June 20, 1973 Japan ..... 48-69335

[52] U.S. Cl. ..... 355/3 DD; 118/637; 222/57

[51] Int. Cl.[2] ..... G03G 15/00

[58] Field of Search ..... 355/3 DD, 14, 17; 118/637, 118/7; 222/57

[56] References Cited

UNITED STATES PATENTS

| | | | |
|---|---|---|---|
| 3,094,049 | 6/1963 | Snelling | 118/637 X |
| 3,376,853 | 4/1968 | Weiler et al. | 118/637 |
| 3,376,854 | 4/1968 | Kamola | 118/637 |
| 3,399,652 | 9/1968 | Gawron | 118/637 |
| 3,527,651 | 9/1970 | Shelffo et al. | 118/637 X |
| 3,572,551 | 3/1971 | Gillespie et al. | 118/7 X |
| 3,587,521 | 6/1971 | Rubenstein et al. | 118/7 |
| 3,707,134 | 12/1972 | Gawron | 118/7 |
| 3,719,165 | 3/1973 | Trachienberg et al. | 355/14 X |
| 3,779,204 | 12/1973 | Altmann | 118/637 X |
| 3,821,938 | 7/1974 | Bacon et al. | 118/7 |

*Primary Examiner*—Richard L. Moses

*Attorney, Agent, or Firm*—Fitzpatrick, Cella, Harper & Scinto

[57] ABSTRACT

In a developer density adjusting device comprising concentration detector means for detecting the density of toner in a developer and concentration adjusting means for adjusting the toner to a proper concentration, the detector means is effective to detect the dielectric breakdown voltage of the developer to thereby detect the concentration of the developer and the concentration adjusting means is operable in response to a signal from the detector means.

16 Claims, 19 Drawing Figures

DEVELOPER CONCENTRATION DETECTING AND REPLENISHMENT DEVICE

BACKGROUND OF THE INVENTION

1. Field of the Invention

This invention relates to a device for detecting and adjusting the concentration of a developer for electrophotography or electrostatic recording which is a mixture of magnetic carrier and dielectric toner.

In electrophotography or electrostatic recording, a developer consisting of a carrier and a toner is usually used to develop electrostatic latent images. For example, in the magnet brush development, which image a magnet brush for the development and the conveyance of the developer at the same time time, the developer employed consists of a magnetic carrier such as iron powder or the like and a toner such as colored resin powder or the like, and one of the most essential factors which will affect the developing effect is the mixture ratio, i.e. the concentration, of the developer. More specifically, a portion of the developer which has been attracted to the magnet frictionally slides with respect to the electrostatic latent image so that the latent image is developed into a visible images by the toner in the developer, and during repetition of such process, the toner is gradually consumed from the developer to reduce its percentage with respect to the carrier and thus reduce the density of the developer, with a result that the density of the developed images is gradually reduced. To avoid this, toner must be suitably supplied but, if there is an oversupply of toner, the copy images will have too great a density as well as increased fog. Thus, the concentration of the developer must always be maintained at a proper level in order to continuously produce copy images of a desirable density.

2. Description of the Prior Art

A method of automatically controlling the concentration of the above-described developer is known. Where the developer used is a mixture of differently colored carrier and toner, the mixed color concentration of the developer is varied with the consumption of the toner. Utilizing this, the known method comprises optically detecting such variation to control a toner supply mechanism so as to effect toner supply to the developer in accordance with the detected variation, thereby maintaining the developer at a constant concentration. Also known is a method which utilizes the fact that the resistance value of the developer is varied with the consumption of the toner therein. This latter method comprises measuring said variation as a variation in a current inversely proportional to the resistance, to thereby detect the concentration of the developer, and adjusting the concentration of the developer in accordance with the detected signal.

The former method will not be available if the carrier and the toner are similar in color. Further, it is disadvantageous in that the color detecting optical system, including a light-emitting element, a light-sensing element, etc. is subject to contamination from scattered toner particles, which may result in failure to effect proper concentration detection. In the latter method, which comprises detecting the resistance variation to adjust the concentration, there is a problem that the very high resistivity of the toner in the developer permits only a very small current to flow through the developer, and as a result of which the variation in the current value for the variation in the resistance value is so small that it is very difficult to detect such current and adjust the concentration. This also imposes the necessity of providing a complicated amplifier, which in turn would lead to a higher error in the detection of the concentration and, accordingly, to malfunctioning of the device during toner supply.

Generally, the concentration adjustment has rarely taken into account the effect of the carrier deterioration or fatigue upon the detection of the carrier-toner ratio. The carrier deterioration is known as a phenomenon of the toner coming to cover the surface of the carrier in the developer as the development of electrostatic latent images is frequently repeated. As the carrier deterioration progresses, the color tone of the carrier approaches that of the toner to make the optical concentration detection method useless. Also, the resistance, particularly the dielectric breakdown voltage, of the developer is increased so much that some error will be involved in detecting the proper concentration value of the developer.

All these disadvantages may effectively be eliminated by the present invention.

SUMMARY OF THE INVENTION

It is an object of the present invention to provide a developer concentration detecting, and adjusting device for detecting always accurately and sensitively, the concentration of a developer consisting of a carrier and a toner and for maintaining such developer at a proper concentration.

It is another object of the present invention to provide a developer concentration detecting and adjusting device which differs entirely in principle from the optical or the electrical concentration detection method of the prior art and which is well protected against contamination and can produce a greater detection current.

It is still another object of the present invention to provide a developer concentration detecting and adjusting device which is simple in construction and which directly utilizes a detection signal to operate concentration adjusting means.

It is a further object of the present invention to provide a developer concentration detecting and adjusting device which can compensate for any error in the concentration measurement which results from carrier deterioration, thereby enhancing the accuracy of the detection.

It is still a further object of the present invention to provide a developer concentration detecting and adjusting device which may effectively be used with the magnet brush development, particularly of the sleeve type, in electrophotography.

An essential feature of the present invention is that the concentration of the developer is detected by the variation in the dielectric breakdown voltage of the developer to maintain a constant carrier-toner ratio. A further feature of the present invention is that a signal source, adapted to generate a correcting signal in accordance with the working time and other factors of the developer is used to correct the carrier deterioration in the developer, and thereby maintain the developer at a constant concentration.

The invention will become more fully apparent from the following detailed description thereof taken in conjunction with the accompanying drawings.

DESCRIPTION OF THE PREFERRED EMBODIMENTS

Figure 1:
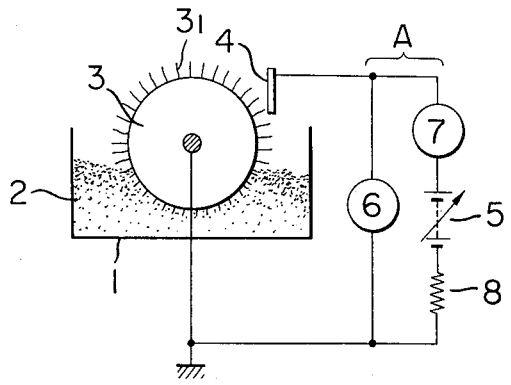
FIG. 1 is a circuit diagram showing an example of the detector means for detecting the dielectric breakdown voltage of electrophotographic developer.

Referring to FIG. 1, there is shown an example of the device for detecting the dielectric breakdown voltage of the developer used in electrophotography. A developer container 1 forming part of an electrophotographic developing device contains therewithin a developer 2 consisting of a magnetic carrier and a toner. A magnet roller 3 has a magnet brush $3_1$ formed thereon by attraction. The developer 2 will have its concentration gradually decreased as it is repeatedly used for the development. The present invention is directed to detecting the concentration of the developer by the variation in the dielectric breakdown voltage of the developer. To achieve this, the detector means may comprise, for example, an electrode 4 disposed in contact with the magnet brush $3_1$ which has been so formed by the magnetic field, and a circuit A inserted between the electrode 4 and the magnet roller 3 and including a variable voltage source 5, a voltage indicator 6, an ammeter 7 and a current adjusting resistor 8. The magnet roller 3 may be replaced by a non-magnetic cylinder or sleeve having a magnet roller therewithin, and one end of the circuit A may be connected to the sleeve. The dielectric breakdown voltage may be measured in a manner which will hereinafter be described.

Figure 2:
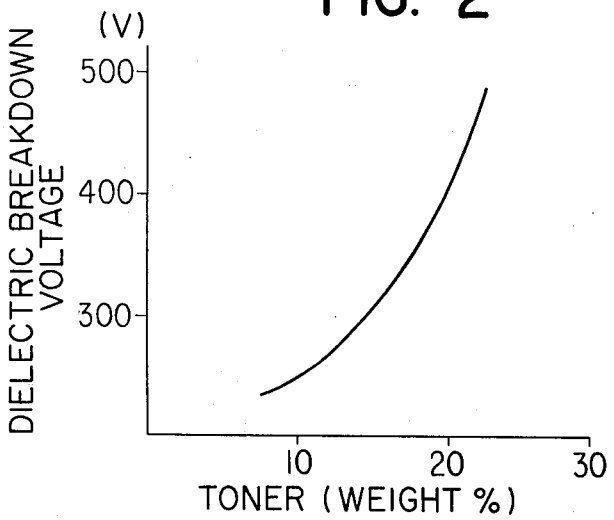
FIG. 2 is a graph illustrating the relationship between the developer concentration and the dielectric breakdown voltage.

A voltage is applied to the electrode 4 with the magnet roller 3 being in rotation. If such voltage is boosted from zero to approximately 1000 volts, current is substantially null until a certain voltage level, say, 300 volts, is reached, but the current will assume a value as determined by the resistor 8 when a higher voltage level (for example, 310 volts) is reached. In other words, the current becomes substantially null when the resistance of the magnet brush $3_1$ exceeds a predetermined voltage. Such voltage is herein referred to as the dielectric breakdown voltage, and the relationship between this dielectric breakdown voltage and the concentration of the developer is empirically shown in FIG. 2. As will be seen, the dielectric breakdown voltage assumes about 300 volts and about 400 volts, respectively for about 14% by weight of toner and about 20% by weight of toner in the developer 2, and no dielectric breakdown occurs for more than the order of 20% by weight.

Figure 3:
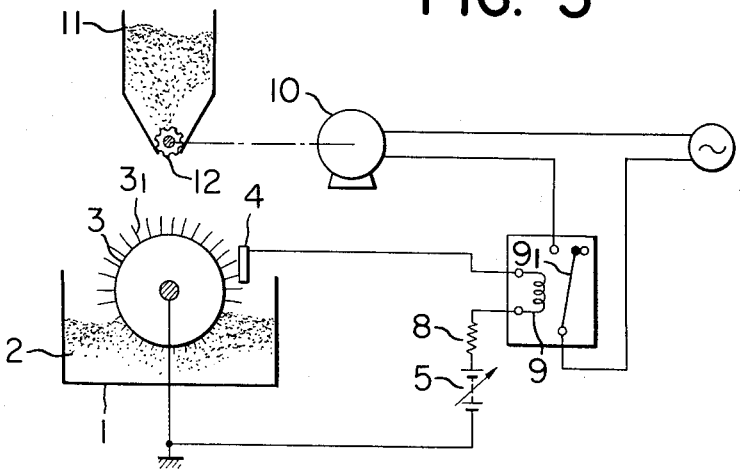
FIGS. 3 and 4 schematically show two forms of the device of the present invention for detecting the dielectric breakdown voltage to effect the toner supply.

Such a phenomenon is utilized to effect automatic adjustment of the developer concentration and an example of it is shown in FIG. 3.

Instead of the ammeter 7 in the circuit portion A of FIG. 1, a relay coil 9 is connected and a contact 9′ thereof is inserted in the circuit of a motor 10. The motor 10 rotates the delivery means, such as grooved roller 12, of a toner supply source 11. In the other points, the arrangement of FIG. 3 is similar to that of FIG. 1.

The magnet brush $3_1$ frictionally slides with respect to a photosensitive medium (not shown) to develop an electrostatic latent image and, when the toner in the developer is comsumed, the dielectric breakdown voltage of the magnet brush $3_1$ falls down to a level lower than the source voltage V, whereupon a current sufficient to energize the electrostatic relay flows to the coil 9 to close its contact $9_1$, thus energizing the motor 10 to operate the toner delivery means 12.

Figure 4:
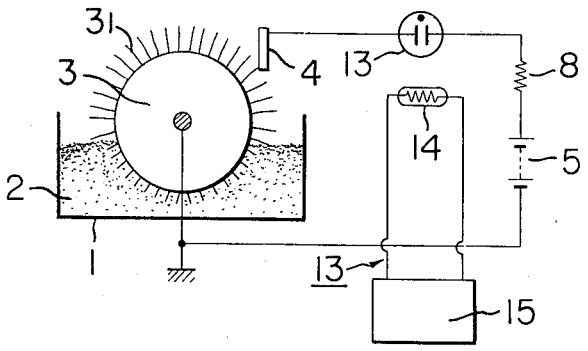

FIG. 4 shows another embodiment of the present invention. In this embodiment, when the magnet brush $3_1$ undergoes dielectric breakdown, a neon tube 13 is turned on to operate a control circuit 15 through a photoelectric element 14 such as CdS cell or the like, thereby energizing the motor to effect toner supply. The voltage source for the control circuit 15 may be a low voltage (5 to 24 volts). The neon lamp 13 serves also as an indicator lamp for indicating that the toner supply is being effected.

Figure 6:
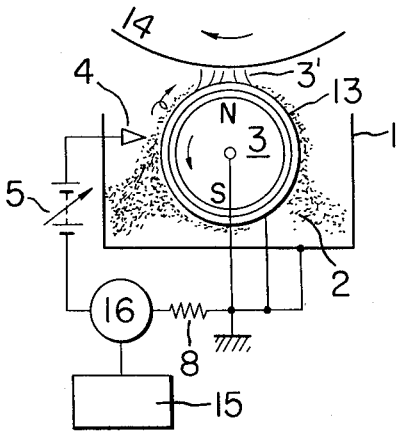
FIG. 6 shows a developer concentration adjusting device which employs a sleeve as the developer conveyor means.

FIG. 6 shows still another embodiment suitable for application in the so-called sleeve type developing method whereby developer is attracted to and conveyed on the surface of a sleeve by magnetism from a rotary magnet within the sleeve. According to this embodiment, the dielectric breakdown is detected to adjust the concentration of the developer. In the figure, reference numerals 1 to 5 are similar in significance to those in FIG. 3, although the electrode 4 is a conventional blade which is a member for limiting the developer to a predetermined amount and thus, it conveniently serves also as a blade. A non-magnetic cylinder or sleeve 13 formed of aluminum or brass has a rotatable magnet roller 3 therewithin, and the sleeve may be grounded or biased by a DC voltage so as to be stationary or rotatable. The blade 4 detects the dielectric breakdown voltage of the developer, limited to the predetermined amount, and therefore, whenever the concentration of the developer is reduced, a current flows from the voltage source 5 through the resistor 8 as a result of the dielectric breakdown, and a current detecting portion 16, such as coil or the like, detects such current to produce a detection signal, which operates the control circuit 15 to permit toner supply. The control circuit 15 may be an amplifier having an amplification degree required in accordance with the dielectric breakdown current substantially determined by the voltage source 5 and resistor 8, or it may be provided by utilizing the exciting action of said current upon a solenoid coil to open-close the supply valve in the toner supply source to effect the toner supply. Thus, it is possible to achieve a very simple concentration adjusting device.

The phenomenon of dielectric breakdown utilized by the present invention will be further described. A mixture of magnetic carrier and toner (dielectric material) has an electrical resistance value, which varies with the ratio of mixture (the resistance of such mixture finally approaches the resistance of the toner itself as the toner is increased), but when a certain voltage is exceeded, the mixture exhibits a resistance value substantially corresponding to or below the resistance value exhibited by the carrier alone, as can be seen from the measurement carried out with respect to FIG. 1. The fact that the dielectric breakdown of a dielectric material such as dielectric film or the like occurs at a certain voltage or higher is generally attributable to the presence of pin-holes in the dielectric material, and analogically it is believed that the dielectric breakdown of the developer occurs due to some relationship between the toner and carrier in the developer and the ambient air.

Figure 5:
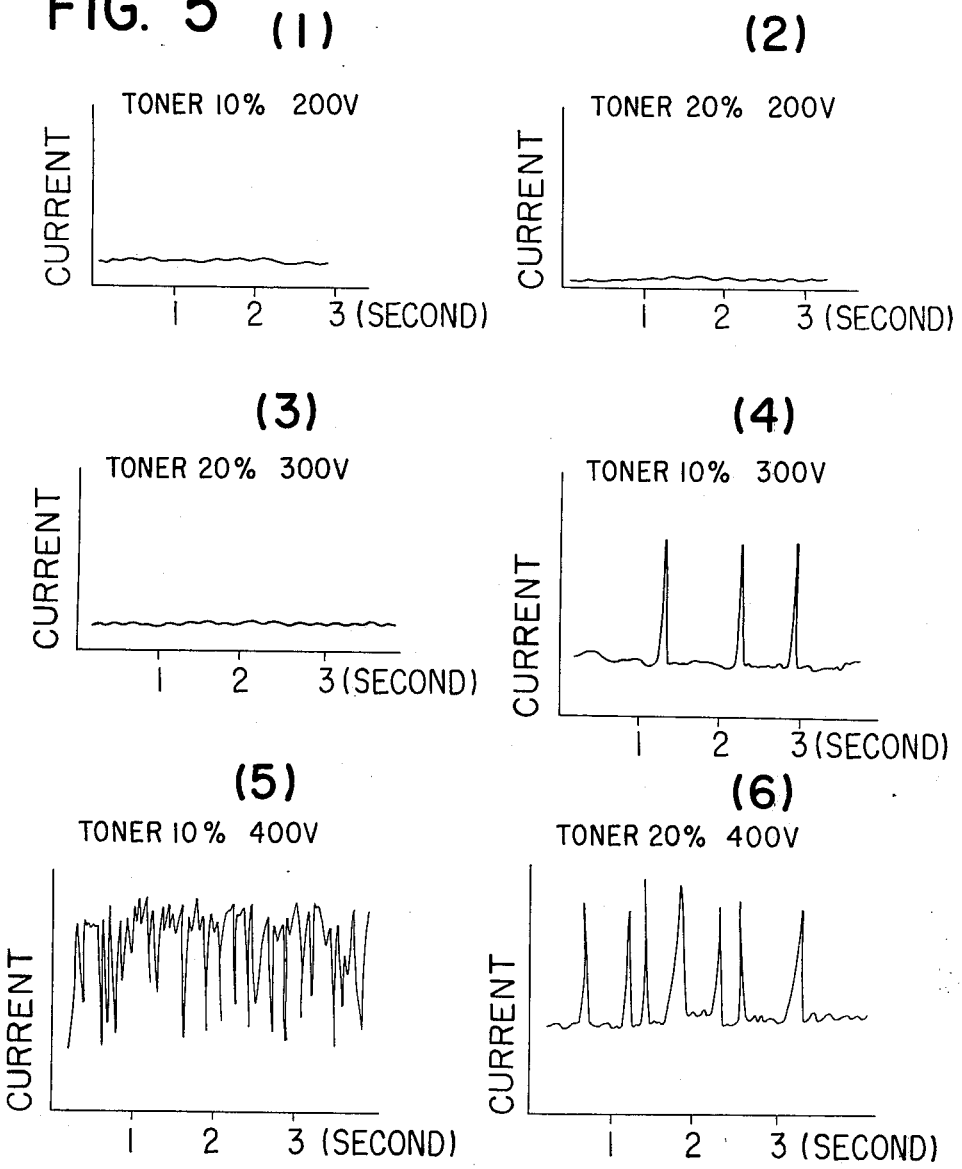
FIGS. 5(1) to (6) are graphs illustrating the current values of the developer under various conditions.

FIGS. 5(1) to (3) depict the the resistance values of the developer under various conditions. As will be seen, at 200 volts, the developer exhibits some resistance values both for toner 10% (FIG. 5(1)) and toner 20% (FIG. 5(2)), the value for the latter case being higher than that for the former case. However, the current values are too small to catch these resistance variations. For example, in case of toner 15%, the resistance value is approximately $10^9\Omega$, which corresponds to a current value of 1 $\mu$A or less. This value is nearly the same level as that which is generally known as noise current. Therefore, detection of such current value and accordingly the concentration of the developer will require a very much complicated amplifier of very high amplification degree which is capable of separating noise and signal from each other. In addition, a further circuit arrangement will be required to drive the toner supply means. Control of the toner supply through the detection of the variation in the resistance value of the developer will encounter great difficulties and require a very complicated construction, and the method of control utilizing the above-described low current will often involve detection error and/or malfunctioning of the control means.

FIGS. 5(4) to (6) typically depict the current waveforms during the dielectric breakdown of the developer. As will be seen, the dielectric breakdown occurs in the form of pulses both at 300 volts for toner 10% (FIG. 5(4)) and at 400 volts for toner 20% (FIG. 5(6)), and each pulse may possibly exceed 10 mA. An average current value of 10 mA may be provided at 400 volts or above for toner 10% (FIG. 5(5)) and at 500 volts or above for toner 20%. This value corresponds to a resistance value of several tens of kilo-ohms, which resistance is considered to be very small and near to short-circuit, unlike the resistance value of the developer for the above-noted mixture ratio in FIGS. 5(1) to (3). Thus, the device for adjusting the developer concentration through the detection of the dielectric breakdown voltage of the developer is more practical and simpler than the device for adjusting the developer concentration through the detection of the current resulting from resistance variation.

The present invention can thus utilize the current produced during dielectric breakdown to directly energize an electromagnetic relay, and this is effective as a device for detecting and adjusting the concentration of electrophotographic developer which is less expensive but stable and compact as well as highly resistive to contamination and which can be easily regulated.

It should be noted that the applied voltage herein shown is variable with the configuration of the electrode, the length of the developing brush, etc. and is never imperative.

Also, in practice, the spacing between the electrode 4 and the magnet roller 3 in FIG. 1 may be suitably varied so that the magnet brush 3' can be provided with a field intensity of about 20 to about 200 V/mm. Thus, the phenomenon regarded as the dielectric breakdown herein may be generated even by using a voltage source 5 of 100 volts or so, and this eliminates the need to provide a protection against high voltage or to provide a high voltage transformer.

The voltage source 5 used to detect the dielectric breakdown is shown as a DC source, whereas it may be replaced by an AC source or a pulse generator. Where an alternating current is employed, the voltage source 5 may be of a lower voltage than where a direct current is employed, because the peak-to-peak voltage of the alternating current deals with the dielectric breakdown.

Further, it is possible to suitably vary the output voltage of the source 5 to suitably vary the concentration of the developer and control the contrast of the developed image. The current after the dielectric breakdown, i.e. the working current for the toner supply means may be suitably varied by varying the resistor 8, but such variation must be set up in accordance with the dielectric breakdown voltage of the developer and the voltage source 5.

Figure 7:
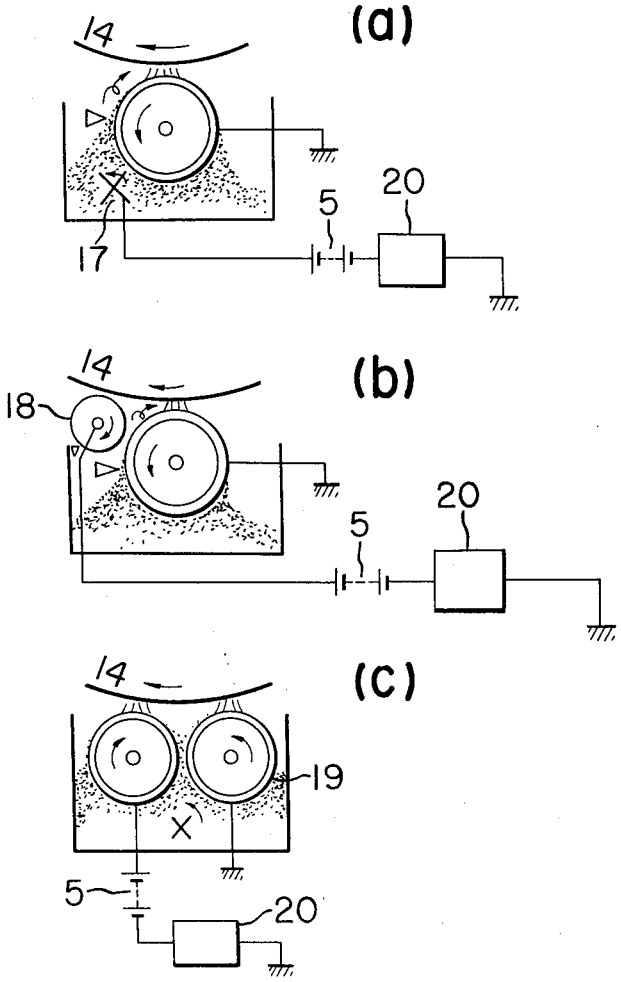
FIGS. 7(*a*) to (*c*) show various forms of the electrode for measuring the dielectric breakdown voltage.

The types of the electrode 4 available for the developing roller such as magnet roller or the like will be shown hereinafter. Typically, an electrode, only functioning to detect the dielectric breakdown voltage and independent of any other component of the developing device, may be disposed within the developer container. The electrode may also take the form of a blade as shown in FIG. 6. Further, alternative forms of the electrode are shown in FIGS. 7(*a*) to (*c*). FIG. 7(*a*) shows an agitating member such as agitator screw or the like for agitating the developer. FIG. 7(*b*) shows a cleaning roller 18 for preventing scattering of the developer and fogging of the image formed on the photosensitive medium 14. FIG. 7(*c*) shows a roller 19 (herein, a sleeve) which is one of two developing rollers used. In the case of FIG. 7(*c*), the voltage, the distance between the rollers and other factors must be selected so as not to impede the development.

There is also a problem that the so-called carrier deterioration, namely, the tendency of the toner to be fused to cover the carrier, may vary (increase) the dielectric breakdown voltage.

Figure 8:
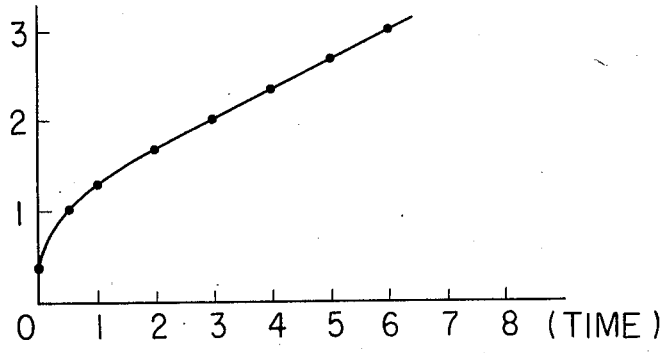
FIG. 8 graphically illustrates the relationship between the agitating time and the resistance ratio of the developer during carrier deterioration.

FIG. 8 illustrates the variation in the resistance value of the developer for the agitating time, with such variation as the measure of the variation in the dielectric breakdown voltage for the carrier deterioration. In the graph of FIG. 8, the abscissa represents the agitating time of the developer while the ordinate represents the electrical resistance ratio of the developer and there is shown the influence resulting from the carrier deterioration with the concentration of the developer as constant.

If the developer density detector means does not take into account the above-described carrier deterioration, there will be a disadvantage that the detector means detects even a lower toner concentration as a proper one, which in turn would result in copy images of poor density as the carrier deterioration progresses.

The above-described influence resulting from the toner deterioration may be compensated for by employing a mechanism for maintaining the developer at a predetermined degree of fatigue by the addition of fresh carrier as well as supplementary toner (for example, toner 60% and carrier 40%, all by weight). In this case, an overflow opening may be formed in a portion of the developing device so as to ensure maintaining a constant volume of developer. Or alternatively, there may be provided a suitable reference voltage source whose voltage increases with the working time of the developer, so that the dielectric breakdown voltage may be compared with the reference voltage to thereby determine the concentration of the developer.

Figure 9:
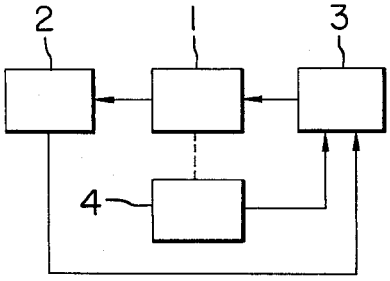
FIG. 9 is a block diagram showing the basic construction of the developer concentration adjusting device in which carrier deterioration is corrected.

Description will now be made of an example of the device for adjusting the developer concentration with the carrier deterioration taken into account. FIG. 9 is a block diagram showing a basic construction for correcting the error in the concentration adjustment resulting from the carrier deterioration. It includes developer 1, concentration detector means 2, concentration adjusting means 3 and a correcting signal source 4. The dotted line shows that the correcting signal source is concerned with the developer. More specifically, the present embodiment employs the correcting signal source 4 for generating a predetermined signal in response to a deterioration signal from the means for detecting the working time of the developer and the number of copies produced, and the concentration detector means 2 which is a signal source for detecting the dielectric breakdown voltage variable with the percentage of the carrier and toner in the developer and for generating a signal. The signals from these two signal sources are compared and discriminated therebetween, whereby a proper amount of supplimentary toner is supplied from the adjusting means 4 to maintain the carrier-toner ratio at a predetermined level at all times. In other words, the concentration detector means 2 detects the variation in the dielectric breakdown voltage of that portion of the developer which is actually performing the developing action, i.e. the variation in the concentration, and the signal B generated by the detector means 2 may include a signal resulting from the toner deterioration and a signal resulting from the variation in the developer concentration accompanying the toner consumption during the development. The signal source A generates the signal A in accordance with the agitating time and the developing time of the developer having a predetermined concentration, so as to correct the variation in the dielectric breakdown voltage resulting from the carrier deterioration during the above-described time.

Figure 10:
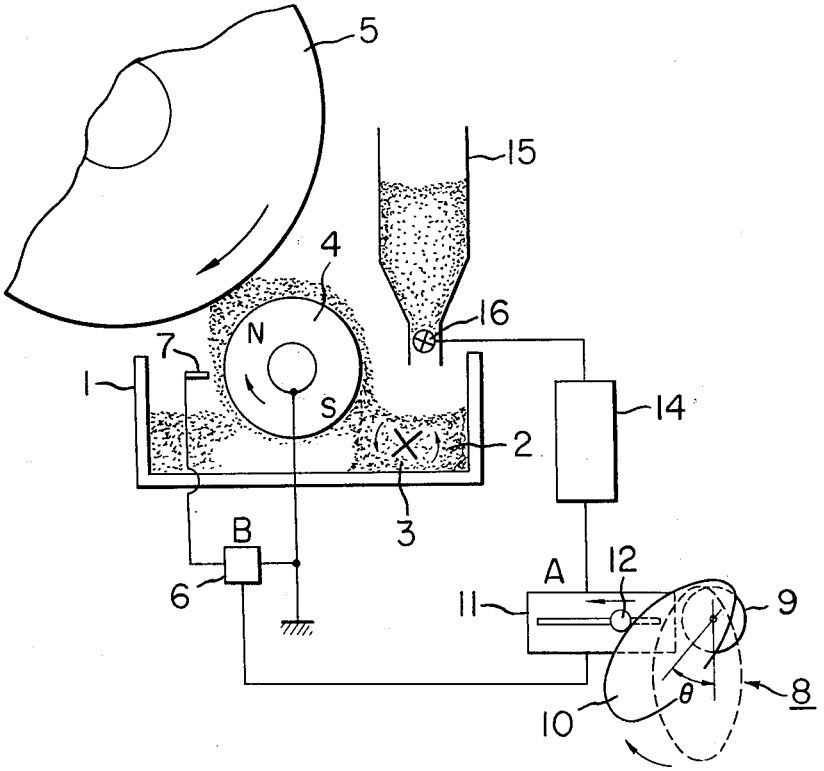
FIGS. 10 through 12 shows various forms of such developer concentration adjusting device.

FIG. 10 shows an embodiment which has embodied the foregoing principles.

In FIG. 10, a container 1 contains therein a developer 2 having magnetic carrier and toner. An agitating member 3 such as a screw or the like is provided for agitating the developer. Conveyor means 4 such as a magnet roller or the like serves to convey the developer to develop an electrostatic latent image formed on a drum-shaped photosensitive medium 5. A signal B may be provided from a measuring portion 6 when the dielectric breakdown voltage of the developer is measured by the conveyor means 4 and a measuring terminal or electrode 7. In contrast, the reference signal A representing the variation in the dielectric breakdown voltage resulting from the carrier deterioration, which accompanies the agitation of the developer, is programmed beforehand on the basis of FIG. 8, for example, and such signal is provided from the signal source of programming means 8.

The programming means 8 includes a rotary time adder 9 operable in accordance with the time during which the developer is agitated by the agitator member 3 and the magnetic conveyor means 4 in the developing device, a plate cam 10 mounted on the rotary shaft of the adder 9, and a slide type variable transformer 11 operatively associated with the cam 10 is selected such that, when the cam 10 is displaced by an angle $\theta$ from its initial position with the rotation of the adder 9, the lever 12 of the slide type variable transformer 11, which is engaged with the cam 10, is also displaced to vary the output voltage of the transformer with time, as shown in FIG. 8. In other words, if the programming means 8 is set so that the output of the transformer 11 increases with the agitating time, the portion of the signal B which corresponds to the increment of the dielectric breakdown voltage resulting from the carrier deterioration may be corrected by using the transformer 11 itself as the voltage source 5 for the detection of the dielectric breakdown voltage in FIG. 1 or other.

In FIG. 10, the detection signal B, so corrected, is amplified by an amplifier 14 so as to control the operation of a toner supply member 16 such as a grooved roller in a hopper 15. However, by using the transformer 11 as the voltage source 5 in FIGS. 1, 3 or other, the current resulting from the dielectric breakdown may directly control the toner supply member. Thus, the carrier deterioration may be compensated for and the concentration of the developer may be maintained constant at all times.

Although the programming means has been described as comprising a rotary adder, a plate cam and a slide type variable transformer, this is not the only possible form, but any other means which can effect programming may be utilized.

In the developing device as described above, the concentration adjustment effected by compensating for the carrier deterioration usually tends to cause the resultant copy images to be fogged, and this may preferably by avoided by reducing the percentage of the toner in the developer. For example, 12% by weight may be the optimum initial percentage for the toner, whereas to produce a thirty-thousandth or subsequent sheet of copy, the vicinity of 8% by weight may be preferable to obtain a fog-free good copy image. The inventors have measured the dielectric breakdown voltages of two types of developer, one with 12% toner content and the other with 8% toner content, between the magnetic conveyor means and the doctor blade, with respect to a first copy sheet and a thrity-thousandth copy sheet. The result is shown in Table 1 below.

Table 1

| Toner Percentage | 1st copy | 30,000th copy |
|---|---|---|
| 12% | 130V | 180V |
| 8% | 105V | 140V |

If, based on this result, the configuration of the cam in the programming means is selected such that the initial toner percentage is maintained at 12% and the toner percentage for the thirty-thousandth and subsequent copies is maintained at 8%, then the resultant copy images may always be fog-free and optimum. Alternatively, for-free and aesthetic copy images may be produced by using a signal A from a signal source initially set to 130 volts and then gradually variable to 140 volts for the 30,000th copy and a signal B from the device for measuring the dielectric breakdown voltage of the developer and by replacing the voltage source 5 of FIG. 3 or other with a slide type transformer which is set to the above-mentioned voltages by said signals. Further, the signal source may be a slide type variable resistor in lieu of the slide type transformer, and such resistor may be used to vary the spacing between the electrodes concerned with the dielectric breakdown voltage, i.e. the electrode 4 and the magnet roller 3 in FIG. 3, to thereby correct the aforementioned voltage.

Figure 11:
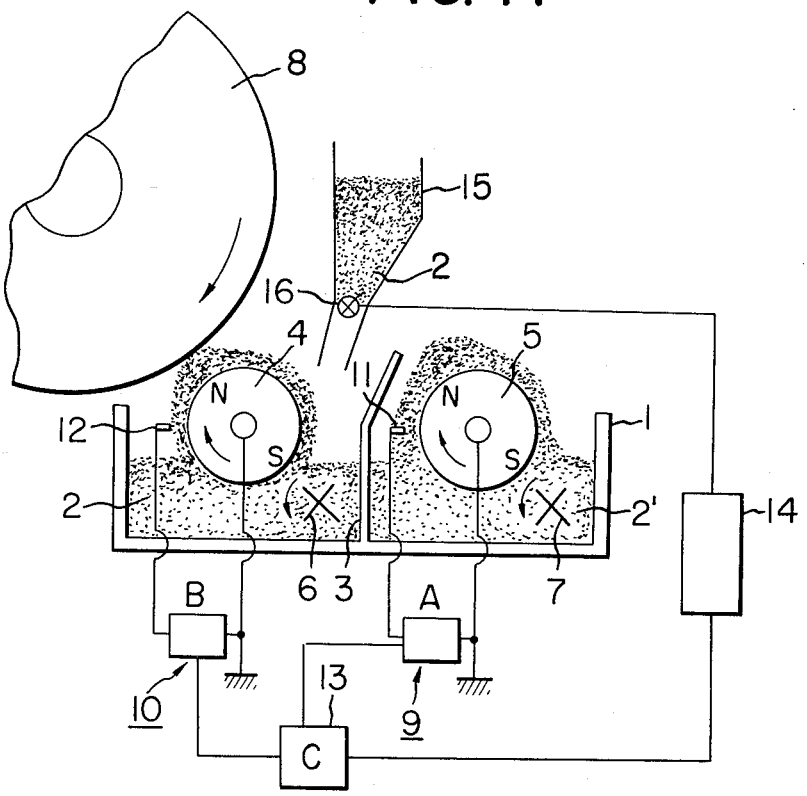

Another embodiment which effects the concentration adjustment by correcting the carrier deterioration will now be described with reference to FIG. 11. In the embodiment of FIG. 11, concentration detector means for the developer which is not actually performing the developing action is employed as the correcting signal source. A container 1 contains therein a developer 2 having magnetic carrier and ordinary toner and has the interior thereof divided into two compartments by a partition plate 3. Similarly configured magnetic conveyor means 4 and 5 and agitating members 6 and 7 perform similar functions within the two compartments, respectively. The only difference is that the conveyor means 4 develops an electrostatic latent image on a drum-shaped photosensitive medium 8 while the conveyor means 5 merely agitates the developer. Therefore, the developers in the two compartments are equal in the degree of fatigue. The measurement of the dielectric breakdown voltage of the developer will now be described. At a measuring station 9, the dielectric breakdown voltage of the developer being merely agitated is measured by the magnetic conveyor means 5 and measuring terminal 11, whereby a signal A is produced. At a measuring station 10, the dielectric developer being agitated while developing the electrostatic latent image is measured by the magnetic conveyor means 4 and measuring terminal 12, whereby a signal B is produced. The signal A represents only the variation in the dielectric breakdown voltage resulting from the carrier deterioration, since the toner in the non-working developer is maintained at a constant concentration without being consumed. The signal B includes the variation in the dielectric breakdown voltage resulting both from the toner concentration variation and the carrier deterioration. Thus, comparator means C compares the signals A and B and corrects the signal B to produce an output for effecting the concentration adjustment with the carrier deterioration taken into account.

Figure 12:
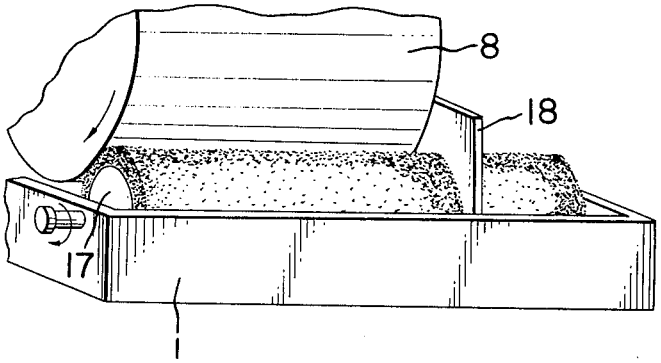

In the device according to the embodiment of FIG. 11, two magnetic conveyor means are discretely provided, but it will be apparent that use may be made of a single magnetic conveyor means 17 separated into a developing portion and a non-developing portion by a partition plate 18, as shown in FIG. 12.

Thus, the present invention utilizes the current produced during the dielectric breakdown to directly energize a relay or the like to properly maintain the concentration and this eliminates the fear to contamination and ensures stable operation as well as permits the mechanical-electrical adjustment of the adjusting device to be achieved easily. Further, according to the present invention, the error in concentration measurement resulting from the carrier deterioration which has been unavoidable with the developer density detection method of the prior art can be compensated for. Thereby, any reduction in the toner concentration may be accurately detected to ensure a proper amount of toner to be supplied, so that copy images of optimum image density may always be produced throughout a long-time use of the developing device.

I claim:

1. A developer replenishment device comprising means for detecting the concentration of toner in a developer, and adjusting the toner to a proper concentration in a developer; said detector means being effective to detect the concentration of toner in said developer by detecting the dielectric breakdown voltage of the developer, and said adjusting means being operable in response to a signal from said detector means, thereby maintaining the optimum mixture of carrier and toner of the developer.

2. A developer replenishment device according to claim 1, further comprising conveyor means for conveying the developer onto a surface bearing an electrostatic latent image, said conveyor means having a magnetic brush formed thereon by the developer consisting of magnetic carrier and dielectric toner, and said concentration detector means being effective to detect the concentration of the developer by detecting the dielectric breakdown voltage of the magnetic brush, thereby maintaining the optimum mixture of carrier and toner of the developer.

3. A developer replenishment device according to claim 2, wherein said detector means includes an electrode being in contact with said magnetic brush, and detects the dielectric breakdown voltage between said electrode and the surface of said conveyor means to thereby detect the concentration of said developer.

4. A developer replenishment device according to claim 2, wherein said conveyor means is a rotatable magnet roller or a sleeve having a rotatable magnet therewithin.

5. A developer replenishment device according to claim 3, wherein said electrode is of a material capable of forming an electrical field of 20 to 200 V/mm between said electrode and said conveyor means.

6. A developer replenishment device according to claim 5, wherein said electrode is in the form of a blade.

7. A developer replenishment device according to claim 2, wherein said adjusting means includes a relay or solenoid operable in response to a dielectric breakdown current from said detector means, and toner supply means operable by said relay ro solenoid, whereby toner supply operation is effected directly by said detection current.

8. A developer replenishment device according to claim 2, wherein said adjusting means includes a light-emitting discharge tube disposed in a circuit rendered conductive by dielectric breakdown before development, and a light-sensing element for detecting the light from said discharge tube, whereby the concentration of the developer is adjusted by the signal from said light-sensing element.

9. A developer replenishment device according to claim 1, further comprising a signal source for generating a correcting signal corresponding to carrier deterioration in the developer, said correcting signal being used to correct a detection signal representing the concentration of the working developer and thereby adjust the concentration of said developer in accordance with the carrier deterioration.

10. A developer replenishment device according to claim 9, wherein said signal source generates a programmed signal which is a predetermined signal corresponding to the working time of the developer or the number of copies produced.

11. A developer replenishment device according to claim 10, wherein said signal source generating a programmed signal includes programming means comprising a rotary time adder operable in accordance with the agitating time of the developer, a cam mounted on the rotary shaft of said adder, and a slide type variable transformer or a slide type variable resistor operatively associated with said cam.

12. A developer replenishment device according to claim 11, wherein said detector means includes a voltage source for detecting the dielectric breakdown voltage of the developer, and said slide type variable transformer is said voltage source.

13. A developer replenishment device according to claim 11, wherein said detector means includes an electrode and conveyor means, and the spacing between said electrode and the surface of said conveyor means is controlled by the output of said slide type variable transformer or resistor.

14. A developer replenishment device according to claim 10, wherein said signal source generates a signal which will provide a toner concentration below the toner concentration provided by said predetermined signal corresponding to the carrier deterioration, whereby a fog-free good copy image may be produced.

15. A device for detecting concentration of a developer consisting of magnetic carrier and dielectric toner, comprising:

means for conveying the developer;

an electrode for detecting dielectric breakdown voltage of a magnetic brush which is formed with said developer at a surface of said conveyor means; and a circuit for generating a signal indicating the concentration of the developer in accordance with a signal produced by said electrode.

16. A device according to claim 15, wherein said conveyor means is a rotatable magnet roller or a sleeve having a rotatable magnet therewith, and said electrode also functions as a blade.

* * * * *

UNITED STATES PATENT OFFICE

CERTIFICATE OF CORRECTION

Patent No. 3,932,034 Dated January 13, 1976

Inventor(s) TORU TAKAHASHI

It is certified that error appears in the above-identified patent and that said Letters Patent are hereby corrected as shown below:

Column 1, line 14, delete "image" and insert --uses--;

Column 1, line 25, "images" should read --image--;

Column 4, line 19, "comsumed" should read --consumed--;

Column 5, line 19, "the the" should read --the--;

Column 7, line 35, "supplimentary" should read --supplementary--;

Column 8, line 29, "or other," should read --or others,--;

Column 8, line 44, "by avoided" should read --be avoided--;

Column 9, line 2, "for-free" should read --fog-free--;

Column 10, line 2, "density" should read --concentration--;

Column 10, claim 1, line 12, "and adjusting" should read --and means for adjusting--;

Column 10, claim 7, line 52, "ro" should read --or--.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*